US006951066B2

(12) United States Patent
Snow

(10) Patent No.: US 6,951,066 B2
(45) Date of Patent: Oct. 4, 2005

(54) CUSHIONING SOLE FOR AN ARTICLE OF FOOTWEAR

(75) Inventor: Rebecca Snow, Foxboro, MA (US)

(73) Assignee: The Rockport Company, LLC, Canton, MA (US)

( * ) Notice: Subject to any disclaimer, the term of this patent is extended or adjusted under 35 U.S.C. 154(b) by 52 days.

(21) Appl. No.: 10/609,652

(22) Filed: Jul. 1, 2003

(65) Prior Publication Data

US 2005/0000116 A1 Jan. 6, 2005

(51) Int. Cl.[7] ..... A43B 13/18
(52) U.S. Cl. ..... 36/29; 36/28; 36/3 B
(58) Field of Search ..... 36/141, 28, 29, 36/3 B

(56) References Cited

U.S. PATENT DOCUMENTS

| | | | | | |
|---|---|---|---|---|---|
| 1,010,002 | A | | 11/1911 | Stern | |
| 1,605,408 | A | | 11/1926 | Huiskamp | |
| 2,527,414 | A | * | 10/1950 | Hallgren | 36/32 R |
| 2,856,771 | A | | 10/1958 | Anderson | |
| 3,418,731 | A | | 12/1968 | Anciaux | |
| 3,834,046 | A | | 9/1974 | Fowler | |
| 4,075,772 | A | | 2/1978 | Sicurella | |
| 4,095,353 | A | * | 6/1978 | Foldes | 36/11.5 |
| D278,571 | S | * | 4/1985 | Eber | D2/916 |
| 4,509,510 | A | * | 4/1985 | Hook | 36/44 |
| 4,598,484 | A | * | 7/1986 | Ma | 36/3 R |
| 4,845,863 | A | | 7/1989 | Yung-Mao | |
| 4,910,882 | A | | 3/1990 | Göller | |
| 5,035,068 | A | | 7/1991 | Biasi | |
| 5,042,175 | A | | 8/1991 | Ronen et al. | |
| 5,092,060 | A | * | 3/1992 | Frachey et al. | 36/29 |
| 5,233,767 | A | * | 8/1993 | Kramer | 36/28 |
| 5,400,526 | A | | 3/1995 | Sessa | |
| 5,467,536 | A | | 11/1995 | Ramer et al. | |
| 5,607,749 | A | | 3/1997 | Strumor | |
| 5,619,809 | A | | 4/1997 | Sessa | |
| 5,735,804 | A | | 4/1998 | Chan | |
| 5,782,014 | A | | 7/1998 | Peterson | |
| 5,839,208 | A | | 11/1998 | Huang | |
| 5,853,844 | A | | 12/1998 | Wen | |
| 5,894,687 | A | | 4/1999 | Lin | |
| 5,896,680 | A | | 4/1999 | Kim et al. | |
| 5,946,824 | A | | 9/1999 | Tighe et al. | |
| 6,076,282 | A | | 6/2000 | Brue' | |
| 6,131,310 | A | | 10/2000 | Fang | |
| 6,138,383 | A | | 10/2000 | Steinke et al. | |
| 6,195,915 | B1 | | 3/2001 | Russell | |
| 6,266,898 | B1 | | 7/2001 | Cheng | |
| 6,425,194 | B1 | | 7/2002 | Brie | |
| 6,434,859 | B1 | | 8/2002 | Kim | |
| 6,691,432 | B2 | * | 2/2004 | Masseron | 36/28 |
| 2003/0221336 | A1 | | 12/2003 | Krstic | |

FOREIGN PATENT DOCUMENTS

| | | |
|---|---|---|
| CH | 666599 | 8/1988 |
| EP | 0100067 A2 | 2/1984 |
| FR | 1302331 | 12/1962 |

OTHER PUBLICATIONS

Translating of FR 1302331 previosly cited.*

* cited by examiner

*Primary Examiner*—Ted Kavanaugh
(74) *Attorney, Agent, or Firm*—Sterne, Kessler, Goldstein and Fox P.L.L.C.

(57) ABSTRACT

Disclosed herein is a shoe construction for providing increased cushioning effects. The shoe includes a sole, a footbed, and a layer of a plurality of deformable protrusions disposed between at least a portion of the sole and the footbed, particularly in the heel and the forefoot area of the shoe. Each of the protrusions includes a tip facing and freely movable with respect to a lower surface of the footbed. Each of the protrusions also includes a base fixedly attached to the sole so that the base does not move relative to said sole. The protrusions provide cushioning by bending when a foot presses down upon them. An alternate embodiment shows the cushioning sole adapted for use in a sandal.

16 Claims, 6 Drawing Sheets

CUSHIONING SOLE FOR AN ARTICLE OF FOOTWEAR

BACKGROUND OF THE INVENTION

1. Field of the Invention

This invention relates to the construction of an article of footwear and more specifically to a cushioning construction for the sole of an article of footwear.

2. Background of the Invention

The human foot is a complex and remarkable piece of machinery, capable of withstanding and dissipating many impact forces. The natural padding of fat at the heel, as well as the collapsibility of the arch, help to cushion the foot. Throughout the course of an average day, the feet and legs of an individual are subjected to substantial impact forces. Running, jumping, walking, and even standing exert forces upon the feet and legs of an individual which can lead to soreness, fatigue, and injury.

Although the human foot possesses natural cushioning and rebounding characteristics, the foot may need extra support to overcome many of the forces encountered during extended periods of activity. Unless an individual is wearing shoes which provide proper cushioning and support, the soreness and fatigue resulting from even low levels of activity on unnatural surfaces is acute, and its onset accelerated. The discomfort for the wearer that results may diminish the incentive for further activity. Equally important, inadequately cushioned footwear can lead to injuries such as blisters; muscle, tendon and ligament damage; and bone stress fractures. Improper footwear can also lead to other ailments, including back pain.

In light of these problems, numerous attempts have been made to incorporate into the sole of a shoe improved cushioning and resiliency. For example, attempts have been made to enhance the natural elasticity and energy return of the foot by providing shoes with soles which store energy during compression and return energy during expansion. These attempts have included the formation of shoe soles that include springs, gels or foams. However, these solutions are expensive, and tend to lose their effectiveness over time.

SUMMARY OF THE INVENTION

Accordingly, disclosed herein is a shoe construction for providing increased cushioning effects. The shoe includes a sole, a footbed, and a layer of a plurality of deformable protrusions disposed between at least a portion of the sole and the footbed, particularly in the heel and the forefoot area of the shoe. Each of the protrusions includes a tip facing and freely movable with respect to a lower surface of the footbed. Each of the protrusions also includes a base fixedly attached to the sole so that the base does not move relative to said sole. The protrusions provide cushioning by bending when a foot presses down upon them.

BRIEF DESCRIPTION OF THE DRAWINGS/ FIGURES

The accompanying drawings, which are incorporated herein and form a part of the specification, illustrate the present invention and, together with the description, further serve to explain the principles of the invention and to enable a person skilled in the pertinent art to make and use the invention.

DETAILED DESCRIPTION OF THE INVENTION

Specific embodiments of the present invention are now described with reference to the figures, where like reference numbers indicate identical or functionally similar elements.

Figure 1:
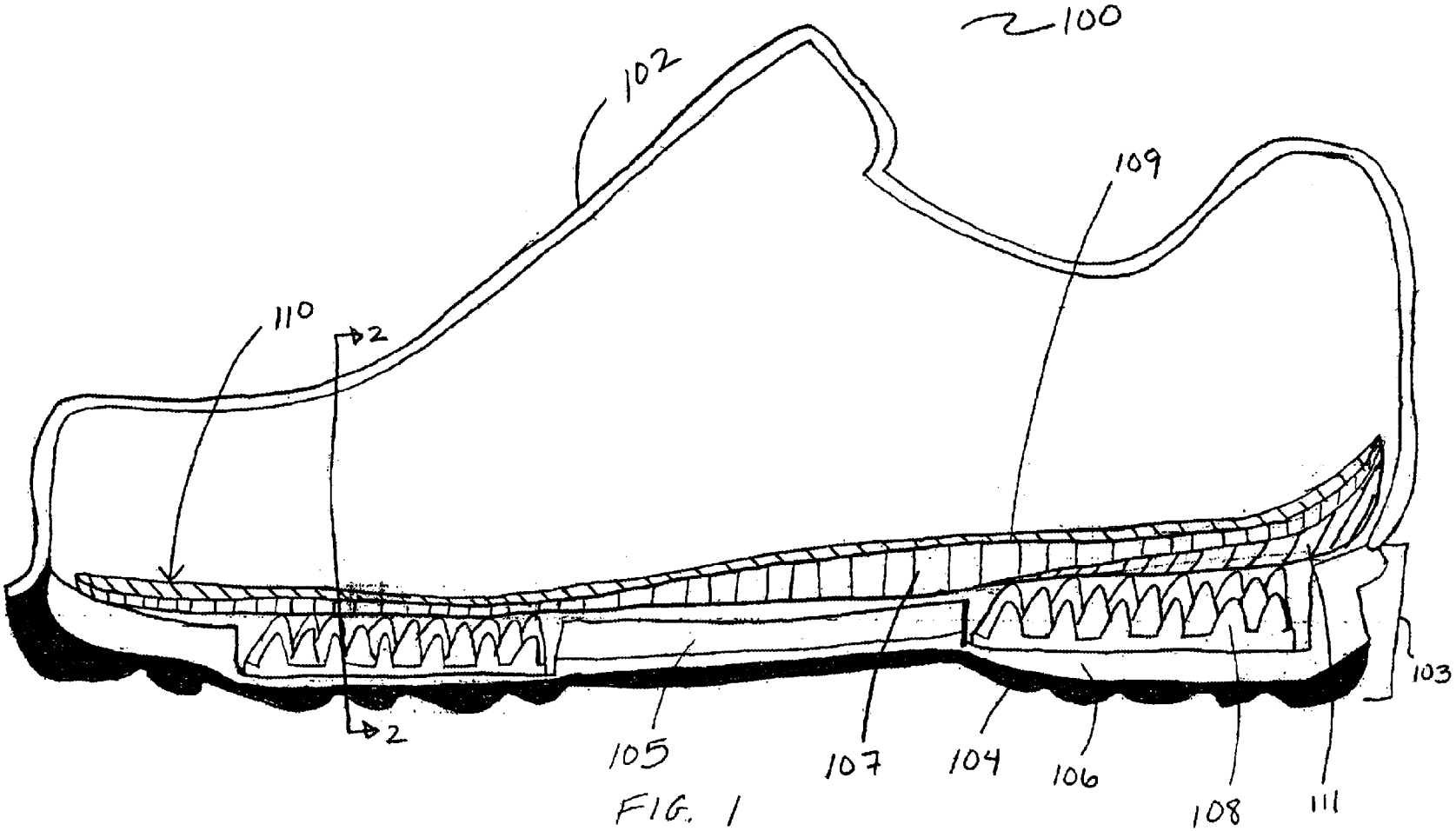
FIG. 1 is a lengthwise cross-sectional view of a shoe according to the present invention.

Referring now to FIG. 1, a shoe 100 according to the present invention is shown in cross-section, the section taken lengthwise (from toe to heel) at the center of shoe 100. A left foot shoe is shown, but it will be apparent to one of ordinary skill in the art that a right foot shoe is merely a mirror image thereof.

Shoe 100 generally includes three basic components, an upper 102, a sole 103, and a footbed 110. Upper 102 can be of any material or design known to one of ordinary skill in the art. Common materials used for upper 102 include leather, woven materials such as canvas, and synthetic materials such as vinyl.

In one embodiment sole 103 includes an outsole 104, a midsole 106, and a plurality of protrusions 108. Outsole 104 is constructed of a resilient, durable material such as rubber. Outsole 104 is intended to provide traction as the ground-engaging surface of shoe 100. In the embodiment shown in FIG. 1, outsole 104 covers the entire lower-most surface of sole 103. It will be apparent to one skilled in the art that outsole 104 may cover only portions of sole 103, or could be eliminated entirely.

As shown in FIG. 1, midsole 106 is disposed between outsole 104 and footbed 110. Midsole 106 provides structure to sole 103, as well as additional padding between a wearer's foot and the ground. However, midsole 106 is generally constructed of a material that is less dense than that used for outsole 104, so that the thickness of sole 103 may be increased, while keeping down the weight of shoe 100. Examples of materials appropriate for midsole 106 include rubber, ethyl vinyl acetate (EVA), polyurethane (PU), and thermoplastic urethane (TPU).

Figure 2:
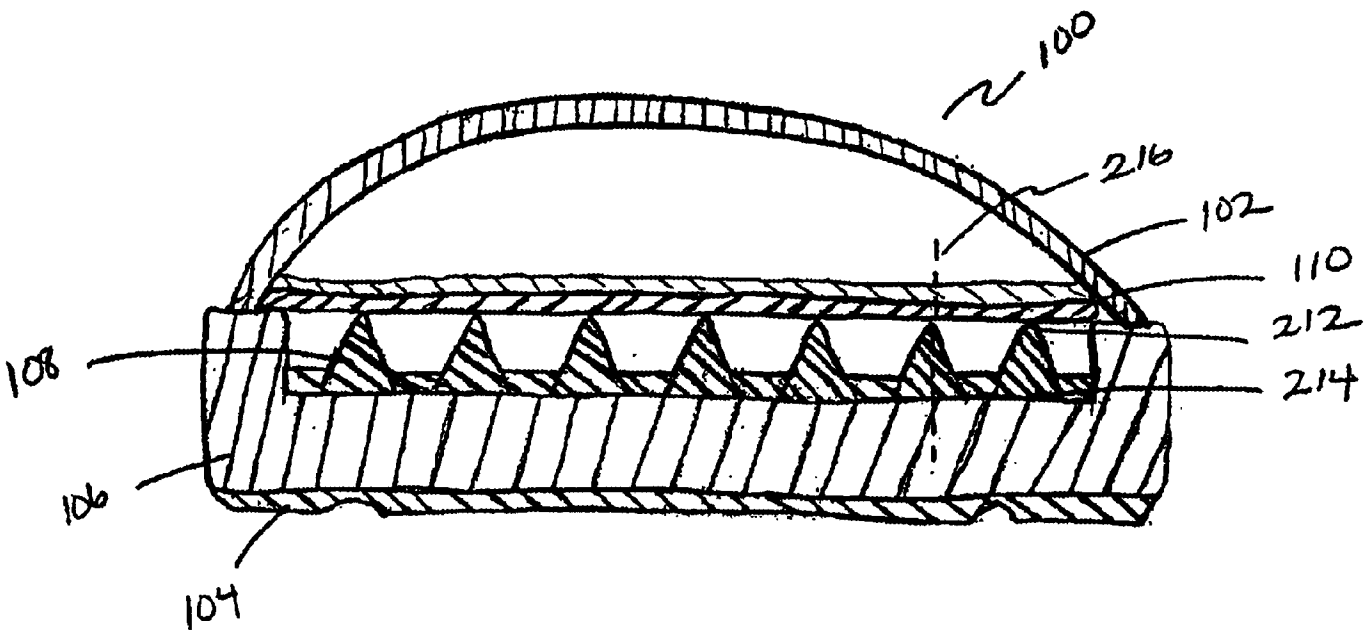
FIG. 2 is an enlarged transverse cross-sectional view of a shoe according to the present invention, taken along line 2—2 of FIG. 1.

In one embodiment midsole 106 is disposed along the entire length of sole 103. In one embodiment midsole 106 is shaped to include depressions in the heel section and the forefoot section of sole 103, as shown in FIGS. 1 and 2. These depressions create space for the insertion of cushioning protrusions 108 so as to minimize the thickness and bulk of sole 103. It will be apparent to one of ordinary skill in the art that these depressions may be altered in length, such as to extend the full length of sole 103, depth, and shape, or even eliminated entirely.

Cushioning protrusions 108 are disposed between midsole 106 and footbed 110. Protrusions 108 may be disposed in the heel region of sole 103, the forefoot region of sole 103, along the entire length and width of sole 103, or a combination of these configurations. In the embodiment shown in FIG. 1, with protrusions 108 located in a heel region and forefoot region of sole 103, with no protrusions 108 in an arch region of sole 103. Instead, an insole layer 105 is stretched across the width of sole 103 in the arch region to increase the stability of shoe 100. The placement of protrusions 108 will depend upon the desired location of cushioning.

Referring now to FIG. 2, protrusions 108 are shown in cross-section taken along line 2—2 in FIG. 1. As can be seen clearly in FIG. 2, each protrusion 108 includes a tip 212 and a base 214. In one embodiment, a vertical axis 216 of protrusions 108 passing through tip 212 is set at a right angle to base 214, i.e., protrusions 108 do not slant towards either a toe region or a heel region of shoe 100. Although other alignments of protrusions 108 are possible, this alignment of protrusions 108 facilitates the proper bending thereof.

Tip 212 touches but is moveable with respect to a lower surface of footbed 110. In the embodiment shown in FIG. 2, base 214 is fixedly attached to midsole 106. In this embodiment, protrusions 108 are formed on a sheet, so that the sheet may be trimmed to an appropriate size to be inserted into the depressions created in midsole 106. However, protrusions 108 could also be individually formed and attached directly to midsole 106, although this process would be very labor intensive and achieving a uniform layer of protrusions could be difficult without skilled technicians. In either case, base 214 of protrusion 108 is attached to midsole 106, either directly or indirectly as part of the sheet, so that base 214 does not move with respect to midsole 106. In one embodiment, base 214 is permanently affixed, such as by cement, although base 214 may alternatively be more temporarily affixed, such as by a temporary adhesive or by hook and loop fasteners such as Velcro®. Such a temporary attachment would allow for custom designs for changing the hardness of protrusions 108 upon demand or to allow for easy replacement of protrusions 108.

Figure 5:
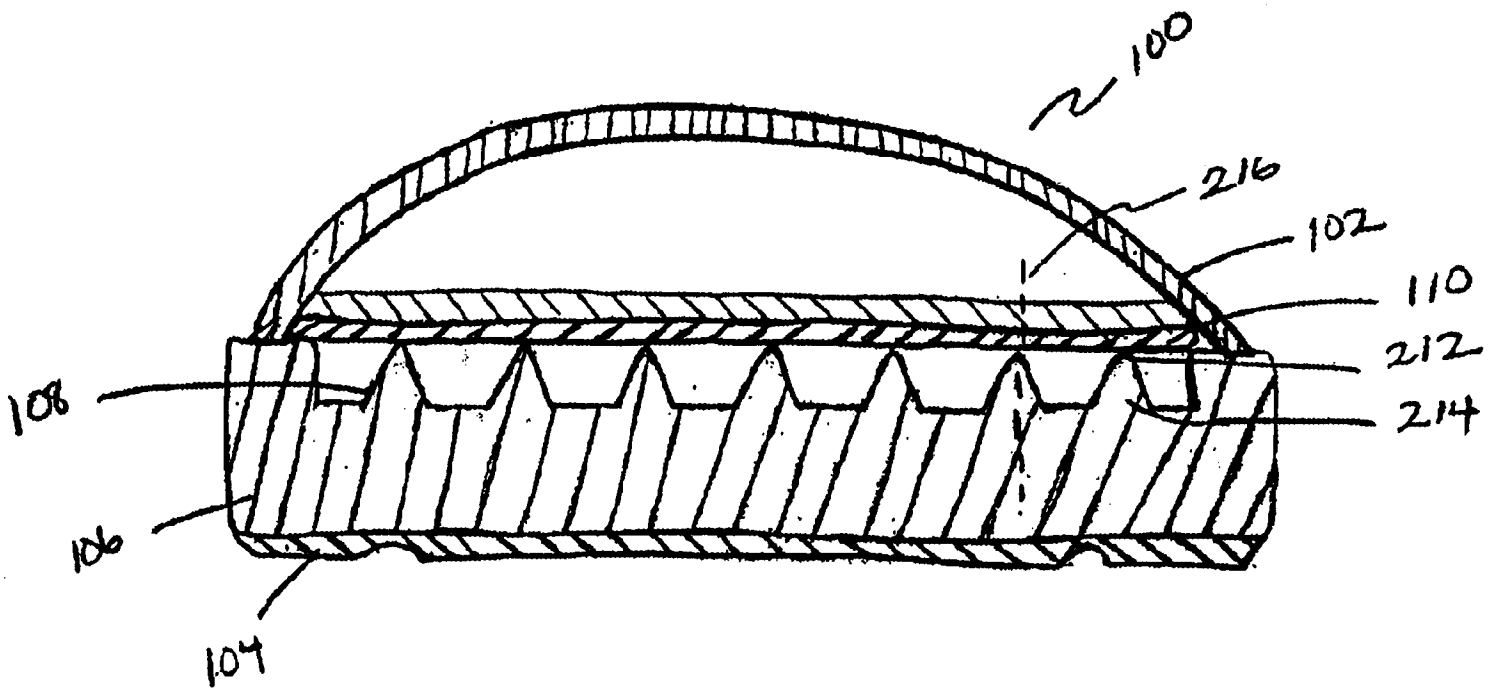
FIG. 5 is an enlarged transverse cross-sectional view of a further alternate embodiment of a shoe according to the present invention.
Figure 6:
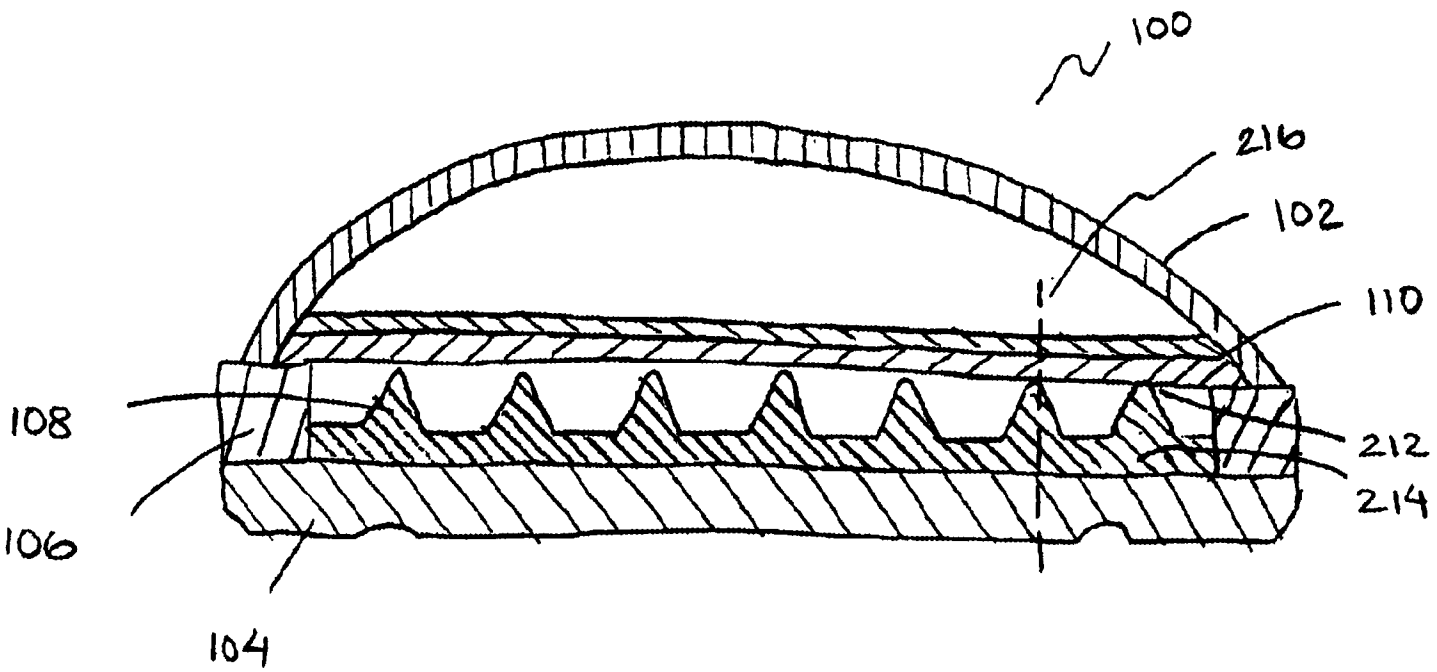
FIG. 6 is an enlarged transverse cross-sectional view of a further alternate embodiment of a shoe according to the present invention.

In addition to attaching protrusions 108 to an upper surface of midsole 106, protrusions 108 may be molded as an integrated part of midsole 106, as shown in FIG. 5. In another embodiment, shown in FIG. 6, protrusions 108 are attached to or integrally molded with outsole 104 so that tips 212 face or even touch footbed 110. Midsole 106 may still be used in this embodiment, where protrusions 108 would project through coordinating windows or holes cut into midsole 106 to touch a lower surface of footbed 110.

Protrusions 108 are formed of a softer material than that of midsole 106, as the cushioning is a result of the ability of protrusions 108 to bend and deform in response to the application of a downward force, such as a step, as will be described in greater detail herein. Appropriate materials are similar to those mentioned above with respect to midsole 106, such as rubber, EVA, thermoplastic rubber (TPR), silicone, thermoplastic elastomers such as SEBS, and urethane, although the density of the materials must be chosen to allow for the cushioning effect from the bending of protrusions 108. If the material is too hard, then protrusions 108 will not bend to a sufficient degree to cushion; if the material is too soft, then protrusions 108 will spread outwardly or crush (as opposed to bending), and the material will wear too quickly. In one embodiment, the durometer for the material in the present invention is in the range of 45–75 on the Asker C scale. However, if protrusions 108 are situated closer to the foot, e.g., if a thin footbed is used, then the material will be softer, so that the bottom of the foot is not irritated.

In one embodiment, protrusions 108 are conical in shape, with tip 212 (i.e., the apex of the cone) facing the bottom surface of footbed 110. Other shapes for protrusions 108 are also possible.

Referring again to FIG. 1, the height of protrusions 108 must be sufficient to allow for bending. For the example durometer range noted above (45–75 on the Asker C scale) of the material, a range of the height of protrusions 108 is between 5 mm to 9 mm. Shorter than 5 mm and protrusions 108 may not bend. Greater than 9 mm and sole 103 becomes prohibitively bulky. However, it will be apparent to those skilled in the art that heights outside of this range are acceptable, such as if a shoe with a platform or otherwise thick sole is being designed or if materials outside of the noted durometer range are used.

The width of protrusions 108 will vary with the height, so that appropriate bending may occur. For the embodiment described above using cone-shaped protrusions, a range of appropriate diameters of base 214 is from approximately 3 mm to 6 mm. Again, this dimension will vary widely, depending upon the shape of protrusions 108, the material used, and the desired amount of bending.

The number and arrangement of protrusions 108 will vary depending upon the dimensions thereof and the level of desired cushioning. Protrusions 108 must be spaced far enough apart so that the bending of protrusions 108 is not inhibited. For the purposes of example only, in one embodiment protrusions 108 are arranged in symmetrical rows. If each conical protrusion 108 is approximately 6 mm high and the diameter of base 214 is approximately 4 mm wide, then the concentration of protrusions 108 is slightly greater than one per centimeter.

Footbed 110 is disposed above protrusions 108. Footbed 110 reduces the tactile sensation of tips 212 of protrusions 108 on the wearer's foot. In one embodiment, footbed 110 includes several layers. In one embodiment, main layer 107 is made of a resilient material, such as PU, with a felt or other soft material as the uppermost layer 109. The heel of footbed 110 may include a heel cup 111 made of a harder, more rigid material to provide additional reduction of the point sensation caused by the tips 212 of protrusions 108. Such materials include plastic, rubber, non-woven synthetic or natural materials or a tightly woven or knitted material.

In one embodiment, footbed 110 is removable, i.e., footbed 110 is not fixedly attached to shoe 100 or sole 103 at any point, but it is merely inserted into shoe 100 and held in place by frictional forces. Alternatively, footbed 110 may be attached to shoe 100 or sole 103 along the periphery thereof, such as by cementing or stitching. However, tips 212 of protrusions 108 should still be freely movable with respect to footbed 110.

The cushioning mechanism of protrusions 108 will now be described with reference to FIG. 2. As a wearer steps down, pressure is applied to footbed 110. Footbed 110 translates this force to protrusions 108, in particular, those protrusions 108 in the vicinity of the force. As tips 212 of protrusions 108 are not attached to footbed 110, protrusions 108 are free to bend and deform to cushion the step. Footbed 110 is sufficiently thick and the bottom material is sufficiently stiff to reduce or eliminate the irritating tactile sensation of tips 212 on the sole of the wearer's foot. However, a massaging sensation due to the movement of protrusions 108 beneath footbed 110 may remain.

Figure 3:
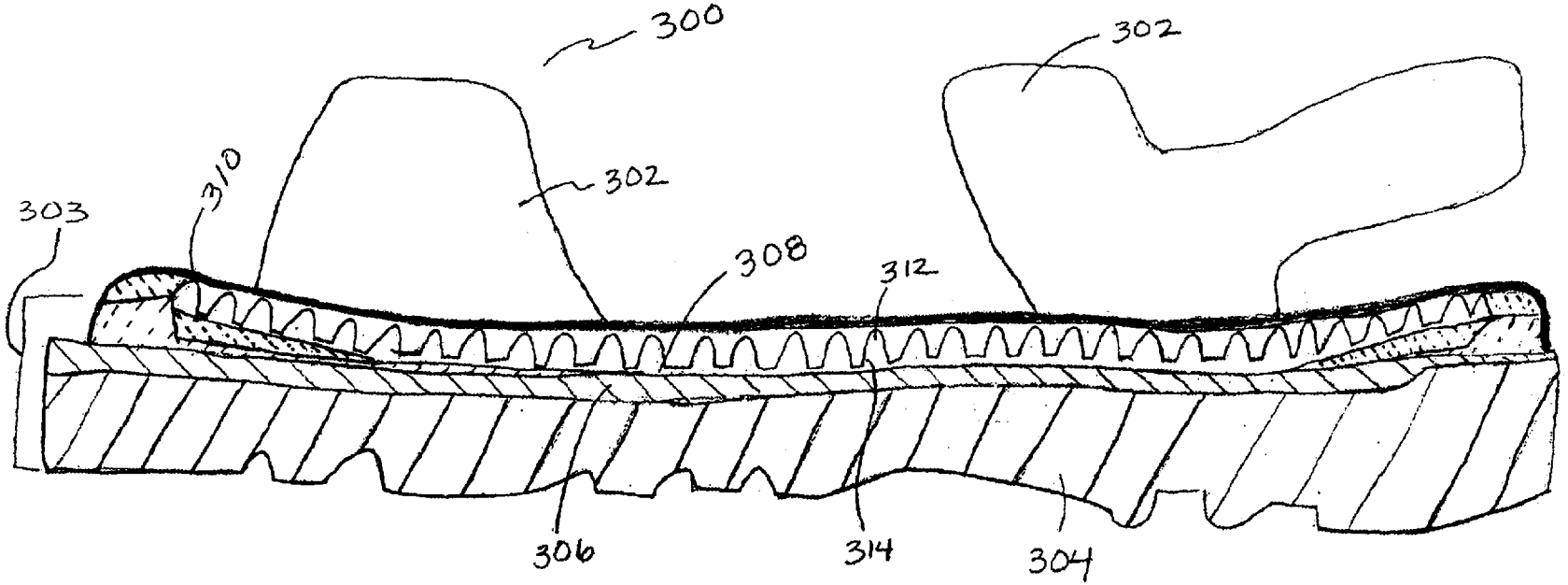
FIG. 3 is a lengthwise cross-sectional view of an alternate embodiment of the present invention, applying the present invention to a sandal.

Referring now to FIG. 3, an alternate embodiment of the present invention is shown. FIG. 3 shows a lengthwise cross-sectional view of a sandal 300 including the cushioning sole of the present invention. The construction of sandal 300 is slightly different from that of shoe 100 (as shown in FIG. 1).

Sandal 300 includes an upper 302 and a sole 303. As is readily apparent to one of ordinary skill in the art, upper 302 is similar to upper 102 in the embodiment discussed above with respect to FIG. 1, although with a relatively open design.

Sole 303 includes one or several layers. In one embodiment with multiple layers, as is shown in FIG. 3, an outsole 304 is a relatively thick layer made of a resilient material such as rubberized or durable EVA. Outsole 304 provides most of the thickness of sole 303. An insole board 306 is typically a non-woven material disposed between hard outsole 304 to cushioning protrusions 308, such as PU or EVA. Insole board 306 helps to control excessive motion of the foot for greater stability. For additional stiffness and stability, sole 303 may also include in the heel and arch regions a rigid plate (not shown) made of a material such as plastic or metal.

It will be apparent to one of ordinary skill in the art that insole board 306 may be eliminated altogether. For such a sole design with only one layer, sole 303 is made of a resilient but lightweight material, such as rubberized EVA, PU, or blown rubber.

Protrusions 308 are similar to protrusions 108, described above with respect to the embodiment shown in FIG. 1, in that protrusions 308 may be disposed in the heel region of sole 303, the forefoot region of sole 303, along the entire length and width of sole 303, or a combination of these configurations. In the embodiment shown in FIG. 3, protrusions 308 are located along the entire length (and width, not shown) of sole 303.

As may be with protrusions 108, in one embodiment protrusions 308 are formed as a sheet, so that the sheet may be cemented to insole board 306. Protrusions 308 are formed of the same materials as described above with respect to protrusions 108, namely rubber, EVA, and urethane, with a hardness in one embodiment in the range of 45–75 on the Asker C scale. Also similar to protrusions 108, protrusions 308 are in one embodiment conical in shape, with a height in a range of 5 mm to 9 mm. All of the variations discussed above with respect to protrusions 108 apply equally to protrusions 308, such as molding protrusions 308 integrally with sole 303 or insole board 306 or altering the shape of protrusions 308.

Finally, a wrapping 310 is attached to outsole 304 around the periphery thereof. Wrapping 310 completely covers protrusions 308 and insole board 306. Wrapping 310 provides many of the same features as footbed 110, described above with respect to FIG. 1. Wrapping 310 adds an aesthetic and tactile effect, as in a sandal wrapping 310 is more visible than a footbed would be in a closed shoe. Wrapping 310 is in one embodiment made of a non-woven material, such as leather, to provide the same force transfer and tactile-sensation reduction as provided by footbed 110. Also, in one embodiment, a separate layer of material is affixed to wrapping 310 to reduce further the tactile sensation of protrusions 310 on the wearer's foot. The attachment of wrapping 310 to outsole 304 can be of any method known in the art, such as by stitching or cementing.

The cushioning mechanism of protrusions 308 is the same as that described above with respect to protrusions 108 in the embodiment shown in FIG. 2.

Figure 4:
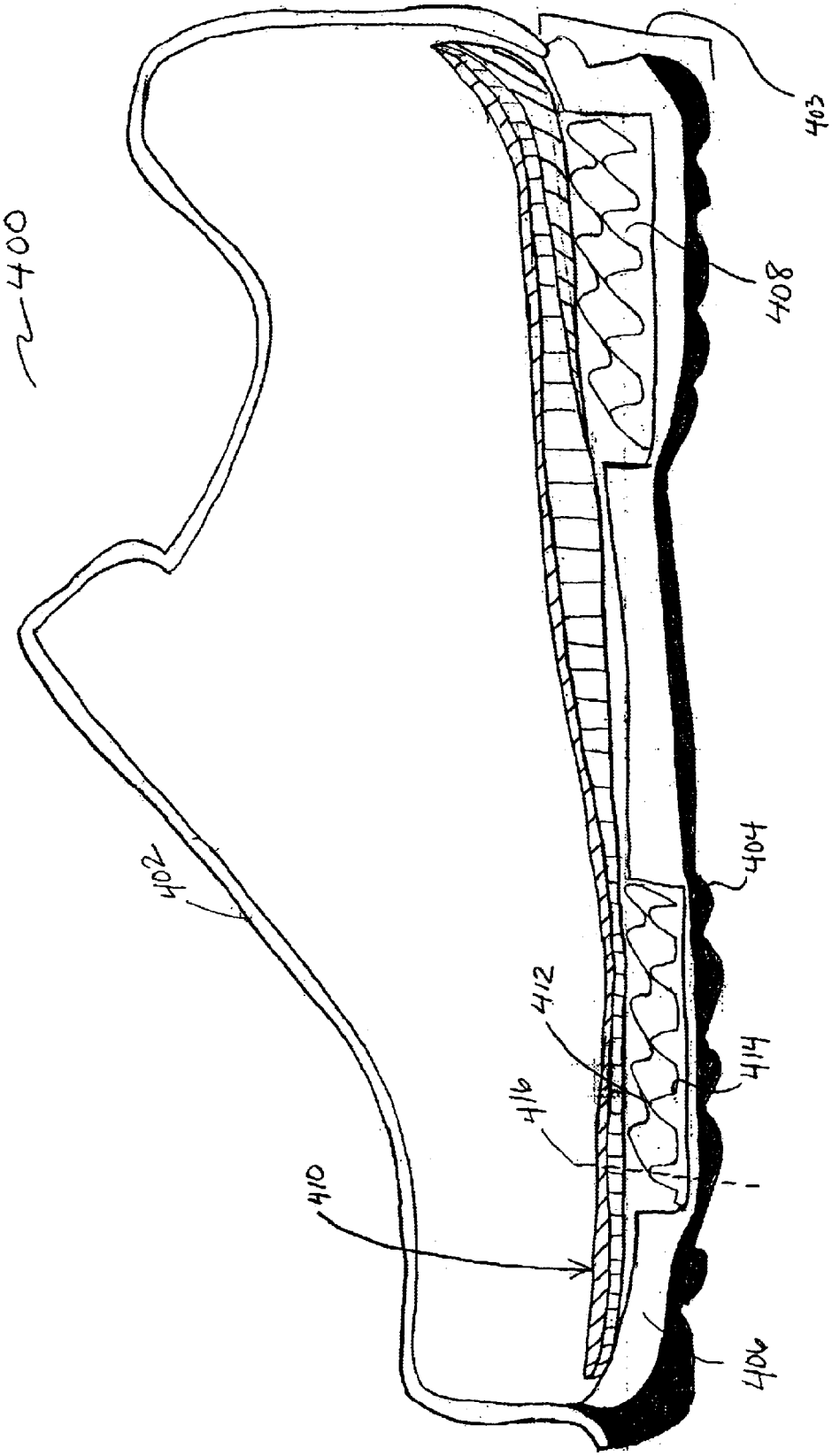
FIG. 4 is a lengthwise cross-sectional view of a further alternate embodiment of a shoe according to the present invention.

Referring now to FIG. 4, a further alternate embodiment of the present invention is shown. A shoe 400 includes an upper 402, a sole 403, and a footbed 410. Upper 402 is comparable in form, structure, and materials with upper 102, described with respect to FIG. 1. Similarly, footbed 410 is comparable to footbed 110, described above with respect to FIG. 1.

In one embodiment sole 403 includes an outsole 404, a midsole 406, and a plurality of protrusions or ridges 408. Outsole 404 is constructed of a resilient, durable material such as rubber. Outsole 404 is intended to provide traction as the ground-engaging surface of shoe 400. In the embodiment shown in FIG. 4, outsole 404 covers the entire lowermost surface of sole 403. It will be apparent to one skilled in the art that outsole 404 may cover only portions of sole 403, or could be eliminated entirely.

As shown in FIG. 4, midsole 406 is disposed between outsole 404 and footbed 410. Midsole 406 is similar in form and function to midsole 106, described above with respect to FIG. 1. Examples of materials appropriate for midsole 406 include rubber, ethyl vinyl acetate (EVA), polyurethane (PU), and thermoplastic urethane (TPU).

In the embodiment shown in FIG. 4 midsole 406 is disposed along the entire length of sole 403. In this embodiment, midsole 406 is shaped to include depressions in the heel section and the forefoot section of sole 403. These depressions create space for the insertion of ridges 408 so as to minimize the thickness and bulk of sole 403. It will be apparent to one of ordinary skill in the art that these depressions may be altered in length, such as to extend the full length of sole 403, depth, and shape, or even eliminated entirely.

Ridges 408 are fin-like protrusions extending transversely across shoe 400. Ridges 408 bend in response to pressure from a wearer's foot to cushion the step, much like the bending of protrusions 108, described above. Ridges 408 could be straight, wavy, curved, set at acute or oblique angles to a longitudinal axis of shoe 400, or any combination of these features. As with protrusions 108, ridges 408 are attached directly to midsole 406 or are formed as a sheet which is attached to midsole 406. In another embodiment where midsole 406 is eliminated from the design, ridges 408 are attached to outsole 404. The attachment of ridges 408 is by any of the methods described above with respect to protrusions 108, such as by cementing or co-molding.

In cross-section, ridges 408 have a tip 412, which is freely movable with respect to footbed 410, extending to a base 414, which is fixedly attached to a midsole 406. In one embodiment, a vertical axis 416 of ridges 408 passing through tip 412 is set at a right angle to base 414, i.e., ridges 408 do not slant towards either a toe region or a heel region of shoe 400. Although other alignments of ridges 408 are possible, this alignment of ridges 408 facilitates the proper bending thereof.

The height and width of ridges 408 is comparable to those of protrusions 108. Ridges 408, however, extend nearly the entire width of shoe 400. Arranged in rows, the concentration of ridges 408 is similar to that of protrusions 108, slightly more than one per centimeter. The materials used for ridges 408 are similar to those used for protrusions 108, namely such as rubber, EVA, thermoplastic rubber (TPR), silicone, thermoplastic elastomers such as SEBS, and urethane. The hardness of these materials is also comparable to that of the materials used in protrusions 108, having a durometer in the range of 45–75 on the Asker C scale. As with protrusions 108, this range will depend upon the dimensions of ridges 408 as well as the placement of ridges 408 in relation to the wearer's foot, e.g., a thinner footbed 410 requires a softer material for ridges 408.

It will be appreciated by those skilled in the art that the features of the invention may be altered to tailor the characteristics of shoe 100, sandal 300, or shoe 400. For example, the layers of sole 103, sole 303, or sole 403 (e.g., outsole 104, midsole 106, and projections 108) may be made of a variety of materials, including but not limited to plastic, foam, and rubber. The various layers may be secured to each other using any one of the many well known methods in the art, such as cementing, welding, or stitching.

Construction of the various layers of sole 103, sole 303, or sole 403 may be accomplished by any one of the many methods known in the art. For instance, the layers may be formed by injection molding, compression molding, or other suitable methods. Also, it is contemplated that the different layers of sole 103, sole 303, or sole 403 described herein can be replaced by one single layer of material, in which the density, flexibility, and pliability may differ throughout the material, or a single material may be used.

While various embodiments of the present invention have been described above, it should be understood that they have been presented by way of example only, and not limitation. It will be apparent to persons skilled in the relevant art that various changes in form and detail can be made therein without departing from the spirit and scope of the invention. Thus, the breadth and scope of the present invention should not be limited by any of the above-described exemplary embodiments, but should be defined only in accordance with the following claims and their equivalents. All patents and publications discussed herein are incorporated in their entirety by reference thereto.

What is claimed is:

1. A cushioning construction, comprising:

a sole;

a removable footbed; and a plurality of deformable protrusions disposed between at least a portion of said sole and said footbed, wherein each of said protrusions includes a blunt curved tip facing and freely movable with respect to a lower surface of said footbed and a base fixedly attached to said sole so that said base does not move relative to said sole.

2. The cushioning construction according to claim 1, wherein said protrusions are generally conical in shape.

3. The cushioning construction according to claim 1, wherein said protrusions are ridges.

4. The cushioning construction according to claim 1, wherein said protrusions are disposed between said sole and said footbed in a heel region of said sole.

5. The cushioning construction according to claim 1, wherein said protrusions are disposed between said sole and said footbed in a forefoot region of said sole.

6. The cushioning construction according to claim 1, wherein said protrusions are disposed between said sole and said footbed along the entire length of said sole.

7. The cushioning construction according to claim 1, wherein said sole and said protrusions are formed as a unitary piece.

8. The cushioning construction according to claim 1, wherein said sole comprises an outsole, wherein said base is fixedly attached to said outsole.

9. The cushioning construction according to claim 1, wherein said sole comprises a midsole and an outsole, wherein said midsole is disposed between said outsole and said protrusions, wherein said base is fixedly attached to said outsole.

10. The cushioning construction according to claim 9, wherein said protrusions project through said midsole.

11. The cushioning construction according to claim 1, wherein said sole comprises a midsole and an outsole, wherein said midsole is disposed between said outsole and said protrusions, wherein said base is fixedly attached to said midsole.

12. The cushioning sole construction according to claim 1, wherein an insole material is disposed between said protrusions and said footbed.

13. The cushioning construction according to claim 1, wherein said footbed is made of a material having a thickness and stiffness that reduces the tactile sensation of said protrusions on a wearer.

14. The cushioning construction according to claim 1, wherein said footbed is made of a material having a thickness and stiffness that eliminates the tactile sensation of said protrusions on a wearer.

15. A cushioning construction, comprising:

a sole;

a removable footbed having multiple layers; and a plurality of deformable protrusions disposed between at least a portion of said sole and said footbed, wherein each of said protrusions includes a tip facing and freely movable with respect to a lower surface of said footbed and a base fixedly attached to said sole so that said base does not move relative to said sole, wherein a layer of said footbed is made of a material having a thickness and stiffness that eliminates the tactile sensation of said protrusions on a wearer.

16. A cushioning construction, comprising:

a sole;

a footbed;

a first plurality of deformable protrusions disposed between a heel region of said sole and said footbed;

a second plurality of deformable protrusions disposed between a forefoot region of said sole and said footbed; and an insole layer disposed in an arch region of said sole, wherein said insole layer separates said first plurality of deformable protrusions from said second plurality of deformable protrusions, and wherein each of said protrusions includes a tip facing and freely movable with respect to a lower surface of said footbed and a base fixedly attached to said sole so that said base does not move relative to said sole.

* * * * *